US006183361B1

(12) United States Patent
Cummings et al.

(10) Patent No.: US 6,183,361 B1
(45) Date of Patent: Feb. 6, 2001

(54) FINITE AND PARI-MUTUAL VIDEO KENO

(75) Inventors: Christopher Cummings, Norcross; William H. Close, Jr., Duluth, both of GA (US)

(73) Assignee: Leisure Time Technology, Inc., Norcross, GA (US)

( * ) Notice: Under 35 U.S.C. 154(b), the term of this patent shall be extended for 0 days.

(21) Appl. No.: 09/092,244

(22) Filed: Jun. 5, 1998

(51) Int. Cl.[7] ..... A63F 9/24
(52) U.S. Cl. ..... 463/18; 463/17; 273/269
(58) Field of Search ..... 463/17, 18, 19, 463/21, 22, 26, 27, 28; 273/269

(56) References Cited

U.S. PATENT DOCUMENTS

| | | | | |
|---|---|---|---|---|
| D. 284,592 | | 7/1986 | Drews et al. | D21/38 |
| 4,635,937 | | 1/1987 | Dickinson et al. | 273/143 R |
| 4,660,833 | | 4/1987 | Dickinson et al. | 273/143 R |
| 4,711,452 | | 12/1987 | Dickinson et al. | 273/143 R |
| 4,817,951 | * | 4/1989 | Crouch et al. | 273/143 R |
| 4,837,728 | | 6/1989 | Barrie et al. | 364/412 |
| 5,058,893 | | 10/1991 | Dickinson et al. | 273/143 R |
| 5,265,874 | | 11/1993 | Dickinson et al. | 273/138 A |
| 5,275,400 | | 1/1994 | Weingardt et al. | 273/85 CP |
| 5,324,035 | * | 6/1994 | Morris et al. | 273/138 A |
| 5,326,104 | | 7/1994 | Pease et al. | 273/138 A |
| 5,380,008 | * | 1/1995 | Mathis et al. | 273/143 R |
| 5,393,067 | | 2/1995 | Paulsen et al. | 273/292 |
| 5,984,779 | * | 11/1999 | Bridgeman et al. | 463/16 |
| 6,024,640 | * | 2/2000 | Walker et al. | 463/17 |

* cited by examiner

*Primary Examiner*—Michael O'Neill
*Assistant Examiner*—Julie Kasick
(74) *Attorney, Agent, or Firm*—Sand & Sebolt

(57) ABSTRACT

A finite keno system includes a game server with one or more player terminals. A game of finite and pari-mutual keno which combines the characteristics of traditional keno with the finite pool concept of scratch-off lottery and pull tab games is played thereon. This finite keno involves the house creating a pool of predetermined outcomes that are stored in the game server. These outcomes are indicative of the catch for that round. Each player chooses its desired numbers and then the game server randomly draws one of the outcomes which indicates the catch, that is the number of matched numbers. The game server then randomly selects a draw in two parts. First, the game server selects the winning numerals of the draw from the player's desired numbers equal in quantity to the outcome numeral, and then the game server randomly selects numbers from the non desired numbers of the player to fill in the remainder of the draw. The effect is that the game meets all of the gaming regulations of various states and countries which forbid banking games but allow for pari-mutual games as the game requires players compete against each other to win from a common pool and are not wagering against the house as the house instead has a predetermined share so long as all of the pool is played.

20 Claims, 3 Drawing Sheets

FINITE AND PARI-MUTUAL VIDEO KENO

BACKGROUND OF THE INVENTION

1. Technical Field

The invention relates to amusement and entertainment games. More particularly, the invention relates to finite-definition amusement and entertainment games which have a finite pool and predetermined number of outcomes, payout, and winners and the system, method and apparatus used to play such games. Specifically, the invention is the game of video keno in a finite format, such as that of pull tabs or scratch off games, where a predetermined and finite pool of winners and losers is defined and then randomly played out as players select their numbers whereby draw numbers are created to match, in full, in part or not at all the numbers of the player's based upon the random winner or loser selection, whereby the video keno game meets all gaming regulations that require players compete against each other to win from a common pool and are not wagering against the house as the house instead has a predetermined share so long as all outcomes in the pool are played.

2. Background Information

The amusement and entertainment game of Keno has been played for thousands of years as it dates back to ancient Chinese dynasties. The game of keno has remained popular for all of these thousands of years as different variations have been developed.

With the overall rise in general standards of living, and specifically disposable income, in the $20^{th}$ century, amusement and entertainment games have soared in popularity as is obvious from the rise of such gaming meccas as Monte Carlo, Las Vegas, Reno, and Atlantic City, as well as the rapid rise in Indian gaming. As a result, many amusement and entertainment games, such as keno, poker, blackjack, bingo and others, have enjoyed both a significant following and continued rise in popularity.

Many applications of keno have been developed including ticket keno, and video or digital keno. These various forms of keno generally involve infinite rounds, unknown payout amounts until play is complete, and are thus not pari-mutual and are instead banked in nature.

Ticket keno is played using play field cards and a bowl with typically 80 numbered balls therein. A paytable or fixed prize schedule is also provided in which odds are displayed. These odds are based upon the number, typically from 2 to 10 (although 1 to 15, or even 1 to 20 are sometimes used), of picks or spots that a player selects from the available numbers (typically an 80 number pool) that are also selected by the house in its draw (typically a 20 number draw).

The object of the game is to have as many hits in your catch as possible. Specifically, after the players have selected their picks or spots, the house draws the winning numbers, typically 20 numbers, referred to as the draw. Each of the draw numbers that matches one of the player's picks or spots is called a hit. The total number of hits is called the catch. The object is therefor to have as many hits in your catch as possible, thus each player wants to have as many of its spots as possible match the numbers drawn in the house draw (although in certain instances there is also a payout for not matching any where a large number of spots was chosen).

An example is as follows, the Keno player decides how many spots or picks to play in this round, for instance 8. The player then marks, using a pen, punchout or other permanent marking means, off of the play field card the 8 spots the player desires from the numbers pool (for instance 1 to 80 which is standard in keno). For instance, this player decides to pick the following 8 numbers: 3, 6, 8, 14, 25, 51, 66, and 80. The player must also indicate a desired wager.

Typically other players are also playing and will have selected their spot, the actual numbers in their spot, and their wager. The house then randomly chooses a predetermined, typically 20, balls from the bowl. Each player then compares its spots to the draw from the bowl. A payout is then determined from the paytable based upon the number of correct spots as a ratio of the number of spots. A sample keno paytable is as follows where the bolded numbers across the top row are the number of spots picked while the numbers in the first column are the catch:

SAMPLE KENO PAYTABLE

| | 2 | 3 | 4 | 5 | 6 | 7 | 8 | 9 | 10 |
|---|---|---|---|---|---|---|---|---|---|
| 0 | 0 | 0 | 0 | 0 | 0 | 0 | 0 | 0 | 1 |
| 1 | 1 | 0 | 0 | 0 | 0 | 0 | 0 | 0 | 0 |
| 2 | 9 | 3 | 2 | 1 | 0 | 0 | 0 | 0 | 0 |
| 3 | | 36 | 7 | 3 | 2 | 1 | 1 | 0 | 0 |
| 4 | | | 63 | 23 | 12 | 6 | 3 | 2 | 1 |
| 5 | | | | 188 | 86 | 34 | 14 | 12 | 5 |
| 6 | | | | | 400 | 160 | 60 | 36 | 25 |
| 7 | | | | | | 800 | 360 | 128 | 80 |
| 8 | | | | | | | 1200 | 480 | 360 |
| 9 | | | | | | | | 2000 | 1000 |
| 10 | | | | | | | | | 4000 |

If the draw included the following numbers: 1, 4, 8, 9, 14, 21, 25, 33, 35, 36, 40, 48, 51, 55, 62, 66, 70, 71, 77, and 80 then the spots of: 3, 6, 8, 14, 25, 51, 66, and 80 result in hits as to 8, 14, 25, 51, 66, and 80, or a catch of 6. Since 8 spots were picked and the catch is 6 then the paytable indicates a payout of 60 (that is 60 times the wager). Obviously, this is a higher payout than a catch of 4 out of 8 spots, or a catch of 6 out of 9 spots, but lower than a catch of 8 out of 8 spots.

Since as indicated above, multiple players could play simultaneously, there may have been multiple payouts as to this particular draw. For instance, another player may have 3 hits in his catch and would thus get his wager back (3 hits from 8 is a payout of 1).

This ticket keno may instead be played in a video format, but in either case a new random draw occurs every so many minutes. Such random selecting of the draw for each round is referred to as "banked" play. Present video keno is of such a banked variety in that the draw generally occurs within that machine only after the player presses play (a random number generator generates the 20 numbers from the pool of 80). Two forms of video play include on lottery type cards and on a digital and interactive screen, where in either case each player picks its spots and awaits a random draw of numbers for the house (the draw). Once again, multiple players may be playing together using different player numbers and the same draw.

In this above described traditional keno, the game has infinite outcomes since each round involves a new draw of 20 numbers from the bowl or random number generator, and thus the same 20 numbers could feasiblely be drawn. In addition, one or more players can be playing each round using one or more sets of player's numbers. Since the number of players is unknown for each round, the player's numbers are unknown for each round, and the house draw and thus the number of winners and losers is unknown for each round until the numbers are randomly drawn, each round has infinite possible outcomes. As a result, the house is playing against the players since the house hopes that its draw is always different from all of the players spots. Since such house vs. players is ripe for fraud, many states and countries have banned such play often called "banked" play.

In contrast, other forms of gaming are available that involve predetermined total outcomes, predetermined payout totals, predetermined payout schedules, etc. These games are finite and pari-mutual because the total quantity of rounds or plays is set or finite, the quantity of winning and losing rounds or plays is known, and the gaming establishment knows how much it will win before any game is ever played. In effect, each player is only playing against other players. This is accomplished by predetermining the total number of outcomes, called the deal, in any particular sequence. The actual outcomes are also secretly determined although the order of such is not known. Then the total percentage to be paid out is determined and the scale or schedule of payout is also determined. Such finite and pari-mutual games are legal in most areas where "banked" games are not, and have thus increased dramatically in popularity.

Two examples of finite and pari-mutual gaming are scratch off paper lottery games, and paper and/or video pull tab games. These games involve the player scratching off, tearing off pull tabs, or opening video doors to reveal symbols or text underneath which are in turn compared to winning patterns whereby a match results in some predetermined winnings.

In the paper games, tickets or cards are printed with a predetermined fixed number of tickets, referred to as the pool image or deal, of which a fixed number are winning tickets and a fixed number are losing tickets. In addition, the schedule of winnings is also predetermined. In sum, the following is predetermined (1) the amount of tickets or cards, for instance 1000, (2) the amount to be paid out, for instance 90% of take from card sales, and (3) the schedule of payout, for instance at $1 per card there would be $900 in payout which could be paid out as one $900 winner, nine hundred $1 winners, or some combination therebetween. The house then knows its take before any tickets are played assuming all tickets are eventually played. The only variable is the order in which the tickets are distributed, and in the case of paper tickets they are generally mixed up either by random printing or thereafter by some means of shuffling. This paper lottery game concept is referred to as a finite game of a pari-mutual nature since there are finite number of tickets and a predetermined number of winners and losers.

Typically, tickets are purchased from the pool until no tickets are left. However, to avoid players from having too much knowledge as to the tickets remaining in a pool, the pools may be very large, multiple tickets are often winners rather than just one or just one big winner, and often multiple pools may be open at one time although each pool is always exclusive from the other pools in terms of number of tickets and winners, and payout.

In the electronic or video games of a finite and pari-mutual nature, the game is similar except that non-volatile memory is used to store the pool of pull tabs. Basically, a predetermined pool of pull tabs is defined and then the game is played where players play the pull tabs from the predetermined pool in a random order. Just as in the paper pull tabs, once a pull tab is played, it is removed from the pool.

These finite and pari-mutual games differ significantly from the banked games in that the players are playing against each other only in finite and pari- mutual games. The house knew before play ever began what its take would be once a pool is closed, it just does not know in what order and to whom the winnings will be paid out to. This is in contrast to banked games such as traditional keno where each draw is random, the game may go on infinitely, and the number of winners and amounts of winnings, if any, are unknown.

It is of importance to note that in finite and pari-mutual games the probabilities of winning change as the number of tickets remaining changes since the pool is defined but diminishing in number. For instance, if 100 rounds of traditional keno were played, the odds in each and every round of a specified catch occurring is the same in all 100 rounds. In contrast, the odds get better with each round in a finite and pari-mutual game because the combinations of each of the previous rounds is removed from the potential draw once it has occurred because it may not occur again in that pool.

The key difference between the banked and finite/pari-mutual is that in finite/pari-mutual games the winning tickets were predetermined and thus a player merely has to select the winning ticket, while in banked games, winning is not predetermined but merely by so called "luck", that is having the random draw produce as many matched, called the catch, as possible.

Presently, no finite and pari-mutual type of keno exists.

SUMMARY OF THE INVENTION

Objectives of the invention include providing a finite and para-mutuel type keno game.

An additional objective is to provide a game server with multiple player terminal system to play this finite keno on where the player terminals are slaves to the master game server.

A further objective is to provide such a game which combines the characteristics of traditional keno with the finite pool concept of used in scratch-off lottery and pull tab games.

A related and further objective is to provide such a game which operates in a finite "deal" based format where the game outcomes are predefined based on hits and misses (winners and losers) as opposed to individual numbers drawn.

A still further related objective is to provide such a game using keno type odds but combining the finite format and process of elimination scheme of pull tabs and similar games.

Another objective is to provide such a game which meets all of the gaming regulations of various states and countries which forbid banking games but allow for pari-mutual games.

A still further objective is to provide such a game that require players compete against each other to win from a common pool and are not wagering against the house as the house instead has a predetermined share so long as all of the pool is played.

These and other objectives and advantages of the invention are obtained by the game, and system, method and apparatus for playing the game of the present invention, the general nature of which may be stated as including a system for playing an amusement and entertainment game of finite keno, the system comprising memory for storing a preselected quantity of predetermined outcomes where each outcome is an indicator of a catch, input means through which a player inputs a set of desired numbers for a round of keno, a processor for randomly selecting one the predetermined outcomes from the plurality of predetermined outcomes thereby indicating the catch for the round of keno, a random number generator for randomly selecting numbers from the desired numbers of the player up to the value defined by the catch, and the random number generator for randomly selecting numbers from an overall pool of numbers that are not in the desired numbers until an overall draw is complete. The system further comprising a game server that includes the processor, memory and random number generator therein, and at least one player terminal that includes the input means therein, the player terminal being electrically coupled to the game server. The method of playing an amusement and entertainment game of a finite keno variety comprising defining an outcome pool having a plurality of predetermined outcomes therein where each predetermined outcome is an indicator defining a number of hits for a draw, selecting a plurality of play numbers from a predefined numbers pool thereby defining the spots for a particular draw of finite keno, randomly choosing one of the outcomes from the outcome pool whereby the indicator defines the number of hits for the particular draw, and defining a set of draw numbers for comparison to the play numbers where the quantity of common numbers between the draw numbers and the play numbers is controlled by the indicator. The step of defining a set of draw numbers includes randomly choosing numbers from the plurality of play numbers equal in quantity to the indicator, and randomly choosing numbers other than those in the play numbers until the draw is fully defined.

BRIEF DESCRIPTION OF THE DRAWINGS

Preferred embodiment of the invention, illustrative of the best mode in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

The invention is a finite and pari-mutual form of keno embodied in a video format, a method of playing finite and pari-mutual keno, and a system through which the finite and pari-mutual keno is played. In short, the method of playing finite and pari-mutual keno involves predefining the quantity of winning and losing tickets or draws (that is the number of hits or misses per ticket) whereby after the players chooses their numbers to play, the system randomly choose from this group of tickets rather than randomly choosing draw numbers.

More specifically, prior to any actual playing of keno, the actual number of winning tickets, that is the number of hits and misses on each ticket, and the amount won by each winning ticket is predetermined. Thus, the house knows its profit before the game begins, and thereafter the players are merely playing amongst themselves for the winnings. The only unknown is the order in which the winning tickets will be distributed as a random generator determines this order. Therefore, in contrast to traditional keno (1) where to win the player must choose a subset of numbers from the total pool of numbers which matches the numbers in the draw and (2) where the winners and amounts thereof are completely unknown prior to selection of both the player's subset and the draw, to win in finite and pari-mutual keno a player must merely be playing the game at a time when a winning outcome is chosen by the random generator irregardless of the numbers chosen by that player. Finite keno does not have an actual draw of random draw numbers and instead involves the creation of a draw to match the predetermined number of hits as is described below in detail. The following system is used to perform this process.

Figure 1:
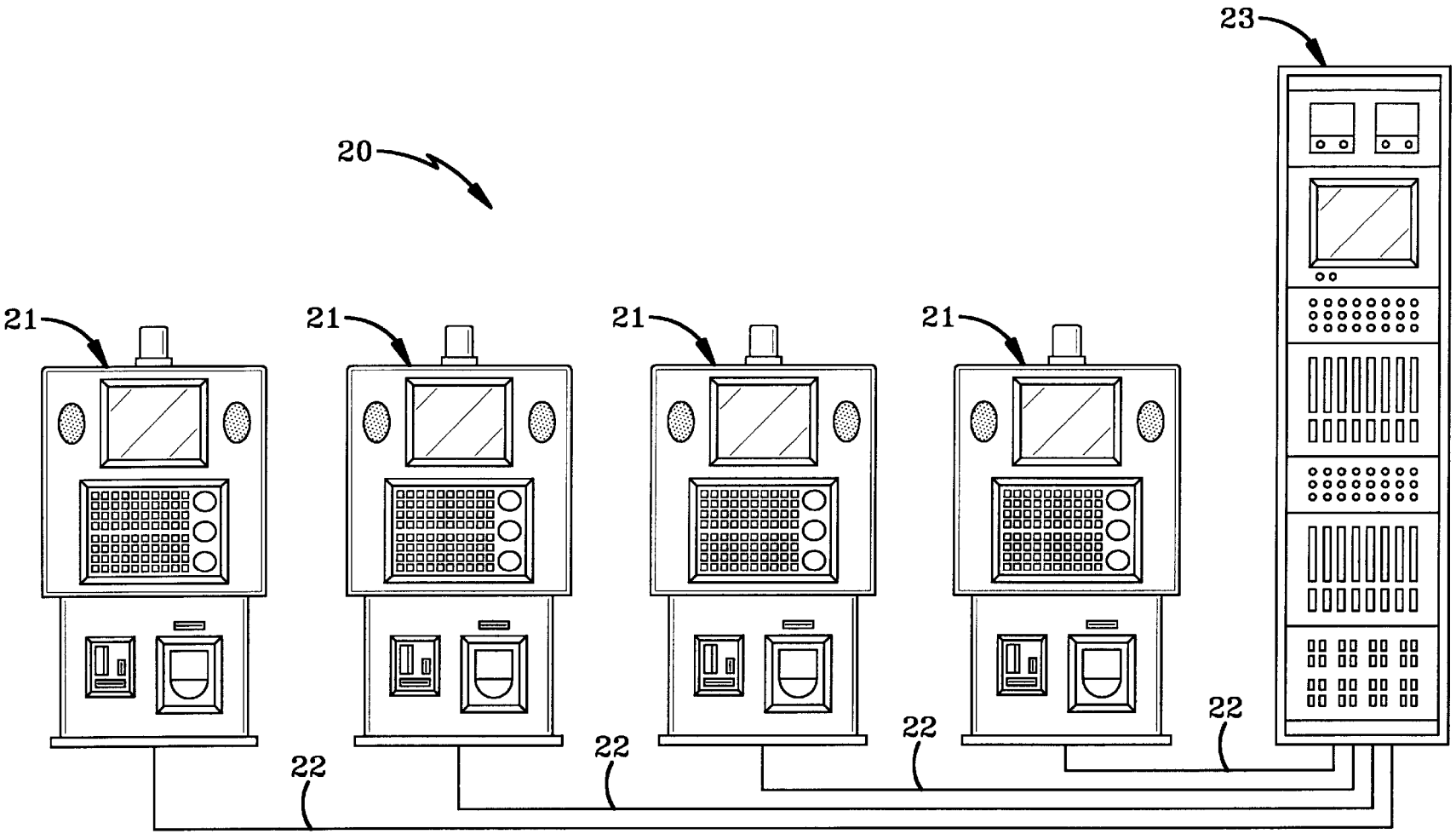
FIG. 1 is a block diagram of the overall finite keno system.
Figure 2:
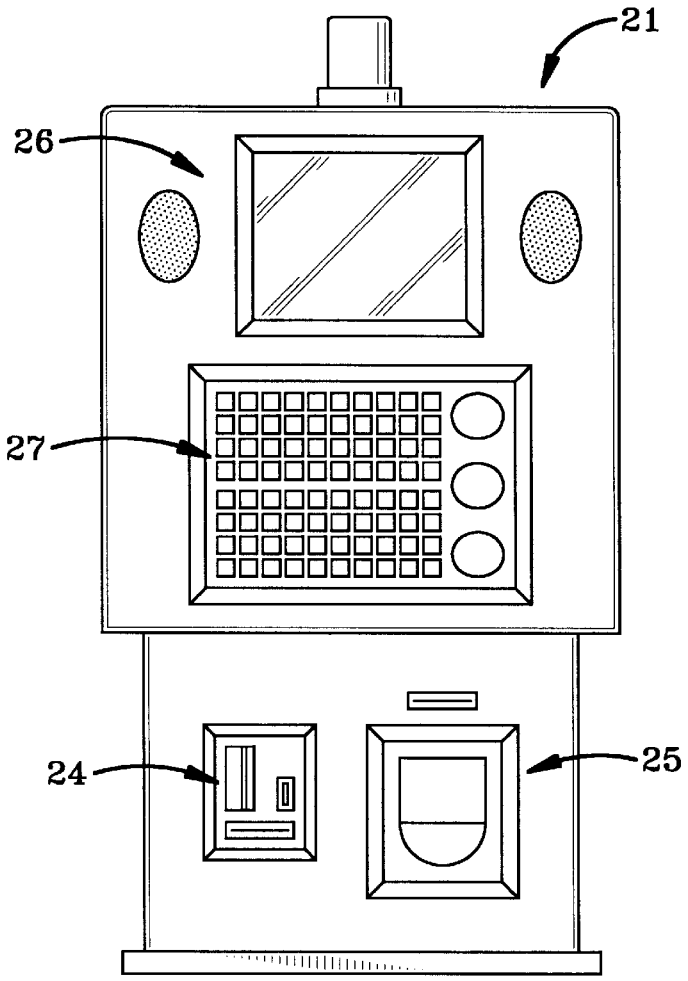
FIG. 2 is a block diagram of the player terminals of the finite keno system as shown in FIG. 1.

In accordance with one of the features of the system the above described method is played on, an improved video keno 20 of a finite and pari-mutual form includes one or more player terminals 21 in electrical communication 22 with a game server 23 as is shown in FIG. 1. Each player terminal 21 as is shown in FIG. 2 includes a means of accepting credit 24 (such as a coin acceptor, a bill acceptor, or a card reader), a means of dispensing prizes 25 (such as a coin hopper, voucher printer, or ticket dispenser), a means of conveying information to the player 26 (typically a video monitor and speakers), and a means of interacting with the player 27 including inputting information into the player terminal (keyboard, mouse, touch pad, or wand and screen prompts).

Figure 3:
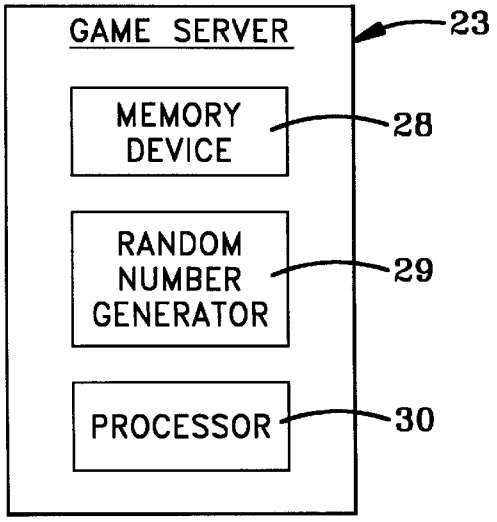
FIG. 3 is a block diagram of the game server of the finite keno system as shown in FIG. 1.
Figure 4:
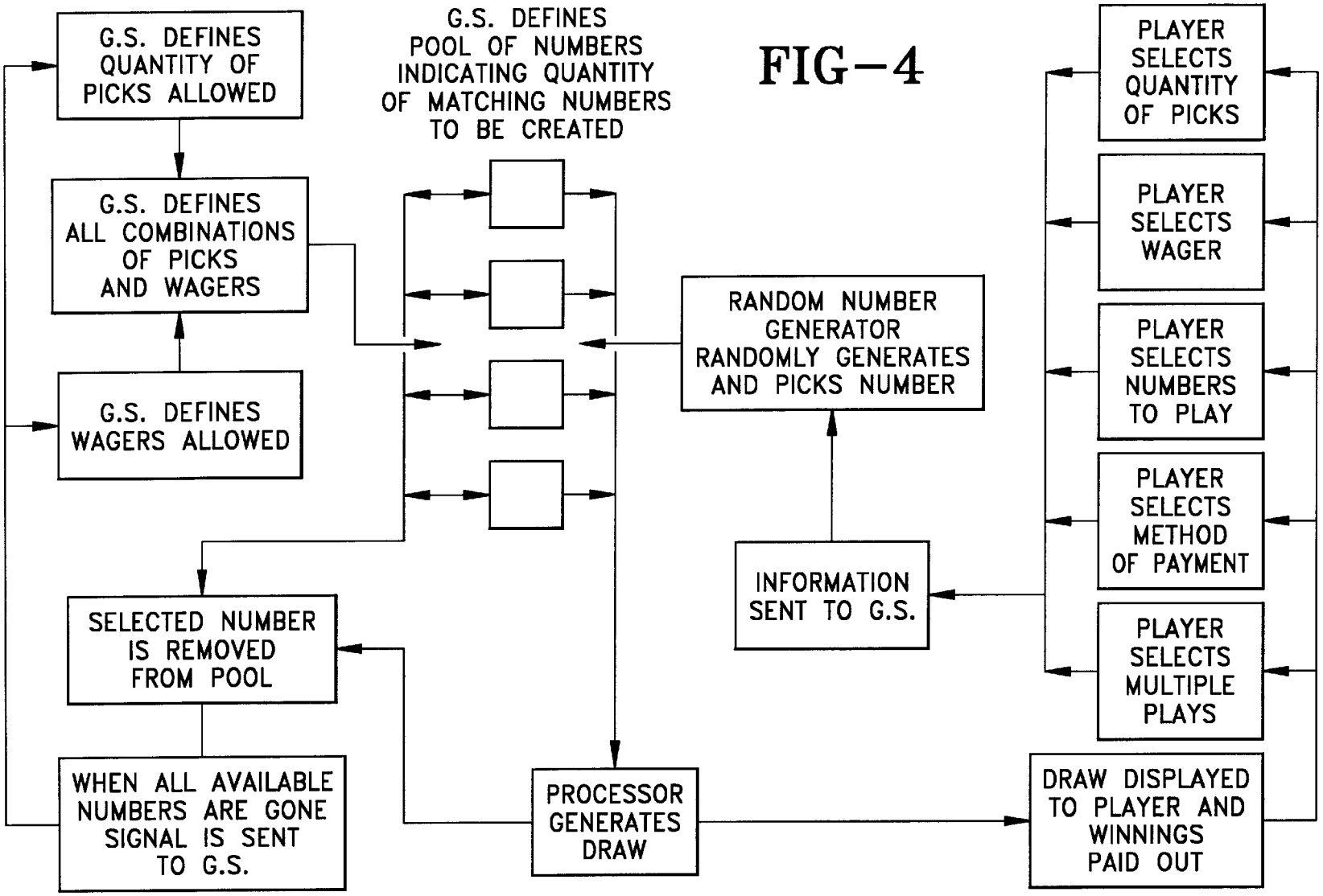
FIG. 4 is a flow chart of the game.

The game server 23 stores information, performs random number generation, and determines game results. The game server 23 as is shown in FIG. 3 includes a memory device 28, a random number generator 29, and a processor 30 to perform these functions. The game server 23 provides a secure storage device and processor that is remote from tampering.

In accordance with one of the features of the invention, the method of playing the finite and pari-mutual keno on the above described game server and player terminals includes the following general steps: (1) defining the quantity of different spots or picks allowed by the players, that is defining the range of numbers that the player is allowed to choose, (2) defining the various wagers allowed by the players, (3) defining all combinations of spots/picks and wager amounts, (4) for each of the combinations, defining a pool of numerals indicative of the quantity of matching numbers to be created in the draw when that numeral is randomly selected, (5) providing the game server having the memory device for storing these pools of numerals, (6) providing player terminals electrically connected to the game server, (7) inputting by a player into one of the terminals the following: (a) quantity of spots that player desires for this play and (b) the wager the player desires for this play, (8) inputting by the player into that same player terminal, either just before, during, or just after step 7, the following: (a) the numbers the player wants to play, (b) a payment option into the means of accepting credit, and (c) optionally, whether the player wants to play these same numbers for multiple plays, (9) displaying the player's numbers and any other desired information on the player terminal (such other information may include current credit, amount of current wager, quantity of picks or spots, odds and/or jackpot for number of matches, etc.), (10) submitting these numbers to the game server, (11) random selecting by the random number generator of a numeral from the pool indicating the quantity of matching numbers to be created in the draw, (12) creating by the processor of a draw that meets the numeral requirement as to the quantity of matches between the player's numbers and the draw, (13) removing that numeral from the pool once used, (14) displaying the draw on the player terminal and optionally showing matches, (15) providing winnings if any, and (16) repeating steps 7 to 14 until one or more of the pools of numerals is used up, and (17) repeating some or all of steps 1 to 4 to replace said used up pools.

The cumulation of the above described steps on the above described system of the game server and player terminals is finite and pari-mutual keno. Each of these steps is described below in more detail. In contrast to standard keno as described above in the background where players choose their numbers and the house independently chooses a draw of numbers and sufficient quantities of matching numbers results in winnings, finite and pari-mutual keno relies on a finite pool of predetermined hits and misses coupled into winning and losing "tickets" or numerals.

As indicated above as step 4, initially a finite pool or deal of outcomes must be defined (if only one quantity of spots and wager is being played, steps 1 to 3 are skipped). This finite pool replaces the actual draw in traditional keno. In actuality it is this finite pool that the players are wagering against rather than the draw as in traditional keno.

In a most simplistic example, the players would be required to select a predetermined number of spots or picks and would have to wager a set amount (for example all players would have to pick 5 numbers and wager $1.00); however, players desire more variety. For this reason, players are allowed to choose the number of spots and wager amounts within predetermined guidelines or ranges (typically 2 to 10 spots and wager choices of 25¢, 50¢, 75¢, $1.00, etc. up to a maximum such as $5.00). Since the choice of number of spots and wager adds variables to the game, we are required to add finite pools because the additional variables would remove the finiteness from each pool if different spots and wagers were to come from the same pool. For this reason, multiple finite pools are required as specified in step 4 based upon the combination total of step 3.

Each finite pool or deal of outcomes is basically a pool of a predetermined fixed number of "tickets", also referred to as cards. Think of each ticket or card as a pull tab card. The number of hits and misses are already known on each pull tab card, but just covered up. In this video keno, each "ticket" in the pool is a numeral indicative of the number of hits (or misses). Thus, each finite pool is merely a plurality of numbers indicative of hits.

Therefore, as briefly described above as steps 1–4, prior to providing player terminals, the house decides how many winners and how much money (what percentage of the pot) it is going to distribute in winnings. The house then also decides the range of spots or picks to allow for the players (as indicated above, this is generally 2–10 although other variations are sometimes used such as 2–15 and 2–20), and the range of wagers to allow.

As indicated at step 4, finite pools are then created for each and every combination of spots and wagers possible. Generally, keno is played in the range of 2–10 spots although other ranges are perfectly acceptable and well within the invention as described herein. Since different numbers of spots are contemplated, a finite pool is defined for each spot, that is one pool for a two spot game, another pool for a three spot game, a third pool for a four spot game, and so forth.

Each finite pool or deal is created with the house specifications in mind as to number of desired winners, total percentage of take in to be paid out, the probability tables for winning (the payout tables), and the spot and wager amount specified. The finite pool or deal is essentially a predetermined group of numbers of a finite amount equating to hits or matches desired, often referred to as the catch, and the group is specific for a certain spot or pick and wager amount. This finite pool or deal is a plurality of outcomes predefined before the game of keno is started. In this video embodiment, these pools are defined and/or stored in non-volatile computer memory, such as Read Only Memory (ROM), in the memory area 28.

After these finite pools of outcomes have been defined, one or more players may play this finite and pari-mutual keno. Each player selects the number of spots or picks that it intends to pick. This selection determines which of the finite pools that player will play for that round.

After the number of spots has been chosen, each player selects its own numbers from the predefined numbers pool. These numbers are that players play numbers. Generally, this pool is the numerals 1–80 although other sets are contemplated and just as easily used. That player must also select its wager.

That player then selects the play feature on the video machine. This play feature causes a random generator to randomly select one of outcomes, that is one of the numerals indicative of number of hits, from the finite pool of outcomes that corresponds to the number of spots that player chose. That outcome is never returned to the pool so the pool is now one outcome smaller.

The selected outcome is a numeral ranging from zero to the number of spots that player chose for this particular round. Once the selected outcome is correlated to a particular round and player, a plurality of draw numbers are created. None, some, or all of these draw numbers may be the same as the play numbers depending upon the numeral provided by the outcome. Specifically, the quantity of identical numbers, or hits, between the draw and play numbers will be that of the numeral provided by the outcome.

In accordance with one of the main features of the invention, the predetermined outcomes replace the number drawing step of traditional keno. Instead of focusing on the random draw of numbers as in traditional keno, the focus is the random selection of one of the predetermined outcomes which are numerals indicative of desired number of hits, or the catch, for that round.

Step 12 then occurs where the processor creates a draw that includes this number of hits, or catch. Basically, the processor reads the numeral indicative of hits and performs two random generating sub-steps therefrom. The first sub-step is to randomly choose numbers from the player's numbers so that the number of hits required by the numeral randomly chosen in step 11 is as desired. The second sub-step is to select the remaining quantity of numbers needed to fill the draw by randomly selected from the group of numbers not chosen by the player.

The draw is then displayed along with other desired information such as the number of hits or catch, the numbers that were hit, winnings, etc. The playing steps, that is steps 7 to 14 or 15, are then repeated until the finite quantity of numbers in the pools are diminished to zero. After one of the finite pools is depleted, a new finite pool is defined and replace it and play resumes.

The finite keno game may be played within many parameters including that of traditional keno where (1) the overall number pool is the numerals 1–80, (2) the range of picks or spots is generally between 2–10, although it may also be 2–15 or 2–20, and (3) the potential number of hits, also referred to as the catch, is from zero to the number of picks or spots. However, as indicated above, finite keno is different in that rather than including a draw step where typically twenty numbers are selected and then compared to each player's spots, a random outcome is chosen from a plurality of outcomes. This random outcome defines the quantity of the catch, and draw numbers are randomly created to fulfill this catch.

For instance, the following example will demonstrate the above defined sequence of the present invention. In this example, it is assumed that the number pool is 1–80 and the pick range is from 2–10 as are often common in keno. Prior to playing any keno, nine different finite pools are created as one is needed for each different spot or pick range. Specifically, a first finite pool is defined for any two spot games, a second finite pool is defined for any three spot games, a third finite pool is defined for any four spot games, a fourth finite pool is defined for any five spot games, and so on until nine finite pools are defined for 2–10 spot games.

Each finite pool contains a predetermined plurality of outcomes. These outcomes are numerals or other indicia indicative of a number between zero and the maximum number of spots available in that particular finite pool. This indicia is basically indicative of the number of hits, or the catch. As a result, the total number of winners is thus predefined. As indicated above this predefining is done to meet all federal, state and local regulations as well as the house's interests.

For instance, if each pool was predetermined to include ten outcomes and it was decided that three should be winners (and the total amount of winnings to be distributed was to be 90%) then the indicia would be defined therefrom. Since each outcome is deemed of a set wager, for example $1, (other pools are required for other wager amounts) and ten outcomes exist and thus ten rounds, then $10 would be the total dollar amount to be wagered of which $9 would be paid out in winnings. The outcomes are then set as seven outcomes of zero (or one or more so long as no payout is associated with this few of hits) for no hits, and three outcomes of a number of hits sufficient to pay out where the odds are correlated with the number of hits such that total payout equals $9. One example would be if 3 hits out of 5 paid 3:1, then three different players in the ten rounds would receive three correct draw numbers. A second example would be if 4 hits out of 5 paid 5:1 while 2 hits out of 5 paid 2:1 then one player in the ten rounds would receive four correct draw numbers and two others would receive two correct draw numbers each.

A first player activates a first video finite keno machine and is asked how many spots it wants to play. The player responds with a number from between 2 and 10 as the number of available spots is a predefined variable. By selecting the number of spots, a particular finite pool is chosen. For instance, the first player chooses to play a five spot game and thus the fourth finite pool is chosen. All of the finite pools are independently separate such that a selection from one pool has no bearing on any of the other pools.

The first player then chooses five numbers, referred to as the play numbers, from the total number pool, in this case 1–80. In the version described in this example, no wager selection is needed as all wagers are $1. (If the player was playing multiple wagers choices, then the player would have had to chose a wager prior to activation of one of the finite pools).

The first player then activates the random outcome generator. A random generator of any kind as is well known in the art then randomly chooses one of the plurality of outcomes. A numeral is associated with this outcome and may be from 0 to 5 in this example as 5 is the maximum number of spots. This numeral was predetermined before the game ever began but it was unknown what order the numeral would be distributed in. In this example, the numeral randomly drawn is three.

This numeral, in this example three, is then used by the game server to create a set of draw numbers to compare with the first player's set of play numbers. The numeral indicates to the number generator associated with the keno machine how many draw numbers should match the play numbers.

As in traditional keno, the quantity of numbers in the draw may be either the amount of the spot, or some number greater. Often in traditional keno, the quantity of draw numbers are 20 while the quantity of player picks is from 2 to 10, or 2 to 15. Again for sake of explanation, we shall assume standard 20 number draw for this example.

Since the player pick was eight and the random numeral drawn was five, the processor must create a draw having five of the player's eight picks therein. The processor, again using a random number generator, randomly chooses five of the player's eight numbers. In addition, the processor, again using the random number generator, randomly chooses thirteen of the remaining numbers (the numbers not chosen by the player from the overall 1–80 pool).

The video terminal then displays the draw numbers. The terminal also displays winnings and allows the first player to observe whether any of its play numbers match any of the draw numbers.

This first player may then play again, in effect as a second player. Also, other players may also be playing on other terminals simultaneous with the first player. However, once each outcome is used, that outcome is removed from the pool of outcomes thereby diminishing the overall pool. It is in this way that the players play against each other and not the house as the houses' portion is predetermined so long as all outcomes are played.

After all outcomes have been played, the pool of outcomes may be reused, although always in a different order as the outcomes are randomly chosen from the pool, or a new pool of outcomes may replace it.

Accordingly, the finite and pari-mutual keno game achieves all the enumerated objectives, provides for eliminating difficulties encountered with prior games, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the finite and pari-mutual keno game is constructed and used, the characteristics of the construction, and the advantageous, new and useful results obtained; the new and useful structures, devices, elements, arrangements, parts and combinations, are set forth in the appended claims.

What is claimed is:

1. A system for playing an amusement and entertainment game of finite keno, the system comprising:

memory for storing a preselected quantity of predetermined outcomes, each outcome is an indicator of a catch defining a value;

input means through which a player inputs a set of desired numbers for a round of keno;

a processor for randomly selecting one of the predetermined outcomes from the plurality of predetermined outcomes thereby indicating the catch for the round of keno;

a random number generator for randomly selecting numbers from the desired numbers of the player up to the value defined by the catch; and the random number generator for randomly selecting numbers from an overall pool of numbers that are not in the desired numbers until an overall draw is complete.

2. The system of claim 1 further comprising a game server that includes the processor, memory and random number generator therein.

3. The system of claim 2 further comprising a plurality of player terminals each of which includes input means and each of which is electrically coupled to the game server.

4. The system of claim 1 further comprising at least one player terminal that includes the input means therein, the player terminal being electrically coupled to the game server.

5. The system of claim 1 further comprising:

a game server having the memory for storing the preselected quantity of predetermined outcomes, the processor for repeated and random selection of an outcome from the preselected quantity of predetermined outcomes, and the random number generator for random number generation of the draw which includes the proper number of winners as defined by the randomly selected outcome; and at least one player terminal having the player number input means for receiving the desired numbers that is compared to the draw to determine winnings.

6. A method of playing an amusement and entertainment game of a finite keno variety, the method comprising the following steps:

defining an outcome pool having a plurality of predetermined outcomes therein where each predetermined outcome is an indicator defining a number of hits for a draw;

selecting a plurality of play numbers from a predefined numbers pool thereby defining spots for a particular draw of finite keno;

randomly choosing one of the outcomes from the outcome pool whereby the indicator defines the number of hits for the particular draw; and defining a set of draw numbers for comparison to the play numbers where the quantity of common numbers between the draw numbers and the play numbers is controlled by the indicator.

7. The method of claim 6 wherein the step of defining a set of draw numbers includes the following steps:

randomly choosing numbers from the plurality of play numbers equal in quantity to the indicator; and randomly choosing numbers other than those in the play numbers until the draw is fully defined.

8. The method of claim 7 further comprising the step of defining a total quantity of numbers in an overall pool of available numbers from which the play numbers are selected and the draw numbers are chosen.

9. The method of claim 7 further comprising the step of defining the quantity of available spots that each player may choose from, and defining an outcome pool for each different available spot.

10. A method of playing an amusement and entertainment game of a finite keno variety, the method comprising the following steps:

defining at least one pool of numerals, each numeral in the pool of numerals being indicative of the quantity of matching numbers to be created in a draw when that numeral is randomly selected;

inputting a set of numbers a player desires to play;

random selecting of a numeral from the pool indicating the quantity of numbers to be created in the draw that must match the inputted set of numbers from the player; and creating the draw that meets the matching requirement as to the quantity of matches between the player's numbers and the draw.

11. The method of claim 10 further comprising, prior to the defining of the at least one pool of numerals step, the following steps:

defining a quantity of different spots available to a player;

defining a pool of wager amounts available to the players;

defining all combinations of spots and wager amounts; and for each of the combinations, defining a pool of numerals ranging from zero to the largest quantity of spots available, each numeral in the pool of numerals being indicative of the quantity of matching numbers to be created in a draw when that numeral is randomly selected.

12. The method of claim 11 further comprising, prior to the inputting of a set of numbers a player desires to play, inputting by the player a quantity of spots that player desires for this play from the quantity of spots available to the player, and the wager the player desires for this play from the pool of wager amounts available to the player.

13. The method of claim 11 further comprising repeating the steps of inputting, randomly selecting, and creating until all of the numerals in all of the pools are used.

14. The method of claim 13 wherein after all of the numerals in a given pool are used, the method further comprises the additional step of defining a new pool of numbers.

15. The method of claim 10 further comprising the step of removing that numeral from the pool once used.

16. The method of claim 10 further comprising the step of displaying the set of numbers the player desires to play and the draw on a player terminal.

17. The method of claim 10 further comprising repeating the steps of inputting, randomly selecting, and creating until all of the numerals in the pool are used.

18. The method of claim 17 wherein after all of the numerals are used in a pool, the method further comprises the additional step of defining a new pool of numbers.

19. The method of claim 10 further comprising a game server having a memory device for storing these pools of numerals.

20. The method of claim 19 further comprising player terminals electrically connected to the game server.

* * * * *